US008542161B2

(12) United States Patent
Chiang et al.

(10) Patent No.: US 8,542,161 B2
(45) Date of Patent: Sep. 24, 2013

(54) DISPLAY DEVICE

(75) Inventors: Yi-Chen Chiang, Hsin-Chu (TW); Yu-Cheng Chen, Hsin-Chu (TW)

(73) Assignee: AU Optronics Corp., Science-Based Industrial Park, Hsin-Chu (TW)

( * ) Notice: Subject to any disclaimer, the term of this patent is extended or adjusted under 35 U.S.C. 154(b) by 559 days.

(21) Appl. No.: 12/498,323

(22) Filed: Jul. 6, 2009

(65) Prior Publication Data

US 2010/0188378 A1 Jul. 29, 2010

(30) Foreign Application Priority Data

Jan. 23, 2009 (TW) ..... 98102927 A

(51) Int. Cl.
*G09G 3/20* (2006.01)

(52) U.S. Cl.
USPC ..... 345/55; 345/84; 345/87; 345/206

(58) Field of Classification Search
USPC ..... 345/55, 87–100, 206
See application file for complete search history.

(56) References Cited

U.S. PATENT DOCUMENTS

| | | | | |
|---|---|---|---|---|
| 7,450,094 | B2 * | 11/2008 | Kim et al. | 345/78 |
| 2001/0050678 | A1 | 12/2001 | Nishikubo | |
| 2002/0044246 | A1 * | 4/2002 | Moon et al. | 349/141 |
| 2002/0093474 | A1 * | 7/2002 | Toyoshima et al. | 345/87 |
| 2003/0011314 | A1 * | 1/2003 | Numao | 315/169.3 |
| 2005/0036091 | A1 | 2/2005 | Song | |
| 2005/0248708 | A1 * | 11/2005 | Park et al. | 349/149 |
| 2006/0103800 | A1 | 5/2006 | Li | |
| 2006/0164352 | A1 | 7/2006 | Yoo | |
| 2008/0074404 | A1 | 3/2008 | Sashida | |
| 2008/0111933 | A1 | 5/2008 | Lee | |
| 2008/0170014 | A1 * | 7/2008 | Jung et al. | 345/82 |
| 2009/0015529 | A1 | 1/2009 | Lai | |
| 2009/0225018 | A1 * | 9/2009 | Kim | 345/90 |

FOREIGN PATENT DOCUMENTS

| | | |
|---|---|---|
| CN | 1811535 A | 8/2006 |
| CN | 100432805 C | 11/2008 |
| TW | 552571 | 9/2003 |
| TW | I253039 | 4/2006 |
| TW | 200822054 | 5/2008 |
| TW | 200903079 | 1/2009 |

* cited by examiner

*Primary Examiner* — Koosha Sharifi-Tafreshi
(74) *Attorney, Agent, or Firm* — Winston Hsu; Scott Margo

(57) ABSTRACT

A display device includes a substrate, gate lines, data lines, gate tracking lines, and dummy gate tracking lines. The gate lines and the data lines are arranged perpendicularly. Each gate tracking line is disposed between one parts of two adjacent data lines, and substantially parallel to the data lines. Each dummy gate tracking line is electrically disconnected to the gate lines, disposed between other parts of two adjacent data lines, and substantially parallel to the data lines.

16 Claims, 8 Drawing Sheets

DISPLAY DEVICE

BACKGROUND OF THE INVENTION

1. Field of the Invention

The present invention relates to a display device and a method of equalizing the loading effect of the display device, and more particularly, to a display device and a method of equalizing the loading effect thereof utilizing the dummy gate tracking lines configured to deliver modulating signals.

2. Description of the Prior Art

Liquid crystal display (LCD) devices are essentially formed by stacking multiple conducting layers and multiple insulating layers. The gate lines, the gate electrodes and the common lines are constructed and formed by the same metal layer (or so called the first metal layer), the data lines are constructed and formed by another metal layer (or so called the second metal layer), and the pixel electrodes are formed by a transparent conducting layer. As for the layout arrangement, because of the layout design or certain inevitable factors, each of conducting layers has a shorter horizontal distance from the adjacent conducting layer. Therefore, signals transmitted in the conducting layers interfere with each other, and lead to the loading effect. When the loading effect generated on each of the pixels is non-equalizing, the loading effect for each of the pixels is not consistent. In such a case, the display quality will be seriously influenced by the non-equalized loading effect. Consequently, as far as the design of display device is concerned, the occurrence of non-equalized loading effect should be avoided as possible.

SUMMARY OF THE INVENTION

One object of the present invention is to provide a display device and a method of equalizing the loading effect of the display device to efficiently improve the display quality of the display device.

To achieve the aforementioned object, the present invention provides a display device. The aforementioned display device includes a substrate, a plurality of gate lines, a plurality of data lines, a plurality of gate tracking lines, and a plurality of dummy gate tracking lines. The gate lines are disposed on the substrate. The data lines are disposed on the substrate, and the gate lines and the data lines are substantially perpendicular to each other. The gate tracking lines are disposed on the substrate, each of the gate tracking lines is electrically connected to a corresponding gate line respectively, and each of the gate tracking lines is substantially parallel to the data lines. The dummy gate tracking lines are disposed on the substrate, each of the dummy gate tracking lines is electrically disconnected to the gate lines, and each of the dummy gate tracking lines is substantially parallel to the data lines.

To achieve the aforementioned object, the present invention provides a method of equalizing loading effect of display device. The method includes following steps: providing a display device; applying a gate driving signal to each of the gate tracking lines respectively; and applying a modulating signal to each of the dummy gate tracking lines, respectively. The display device includes a substrate, a plurality of gate lines, a plurality of data lines, a plurality of gate tracking lines, and a plurality of dummy gate tracking lines. The gate lines are disposed on the substrate. The data lines are disposed on the substrate, and the gate lines and the data lines are substantially perpendicular to each other. The gate tracking lines are disposed on the substrate, each of the gate tracking lines is electrically connected to a corresponding gate line respectively, and each of the gate tracking lines is substantially parallel to the data lines. The dummy gate tracking lines are disposed on the substrate, each of the dummy gate tracking lines is electrically disconnected to the gate lines, and each of the dummy gate tracking lines is substantially parallel to the data lines.

The display device and the method of equalizing the loading effect of the display device of the present invention are characterized by disposing the dummy gate tracking lines between the data lines. The dummy gate tracking lines are electrically disconnected to the gate lines. Besides, the modulating signals are applied to the dummy gate tracking lines so that the loading effect can be generated by the modulating signals. Meanwhile, the aforementioned loading effect is similar to the loading effect generated by the gate tracking lines. In such a case, the display panel can have equalized loading effect so that the display quality of the display device can be efficiently improved.

These and other objectives of the present invention will no doubt become obvious to those of ordinary skill in the art after reading the following detailed description of the preferred embodiment that is illustrated in the various figures and drawings.

DETAILED DESCRIPTION

To provide a better understanding of the presented invention, preferred embodiments will be detailed as follows. The preferred embodiments of the present invention are illustrated in the accompanying drawings with numbered elements to elaborate the contents and effects to be achieved. In the abovementioned embodiment, the liquid crystal display device is illustrated to explain the display device of the present invention, but the application of the present invention is not limited thereto. However, the present invention can be applied for all kinds of the display devices.

Figure 1:
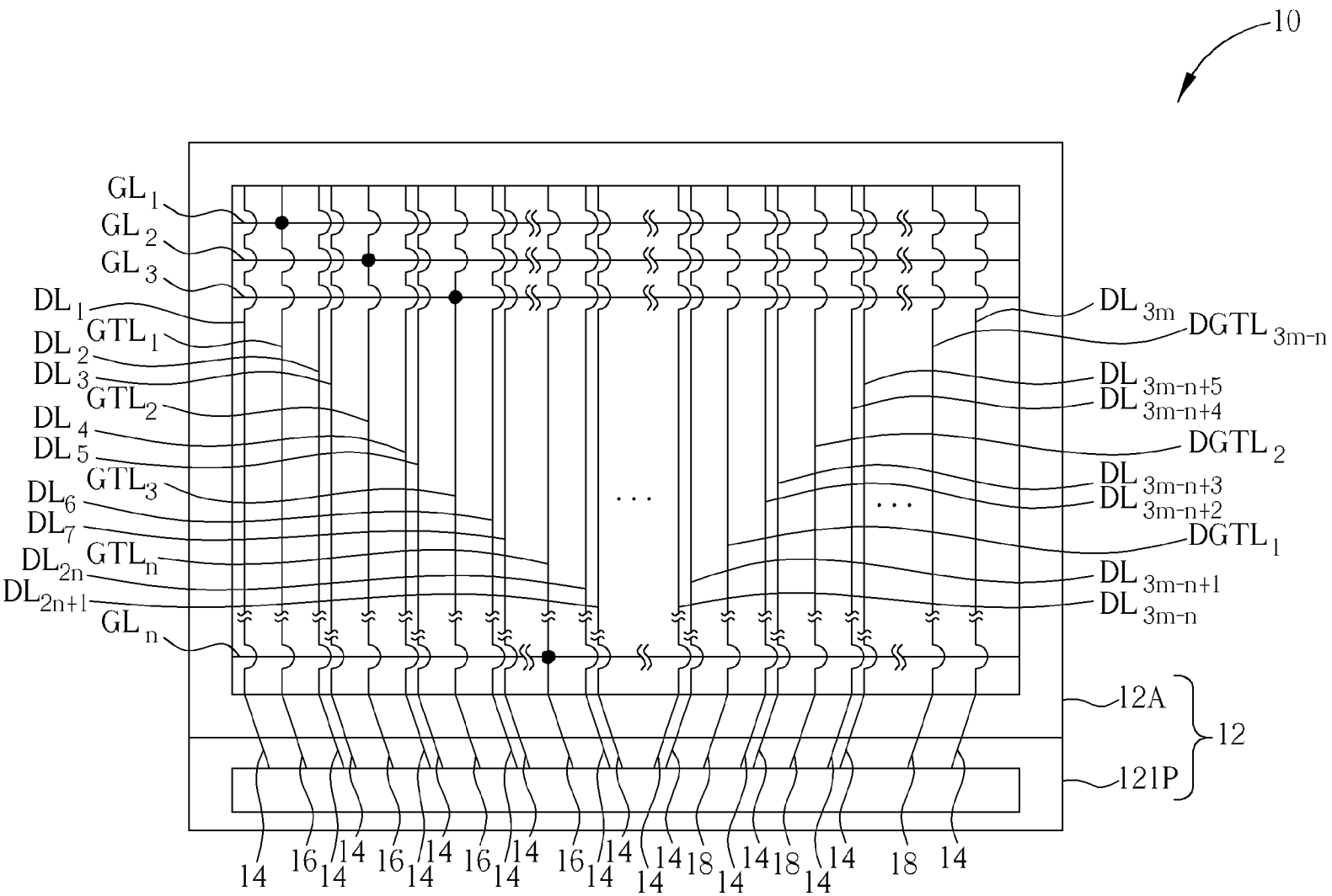
FIG. 1 is a schematic diagram illustrating the display device of a first preferred embodiment of the present invention.
Figure 2:
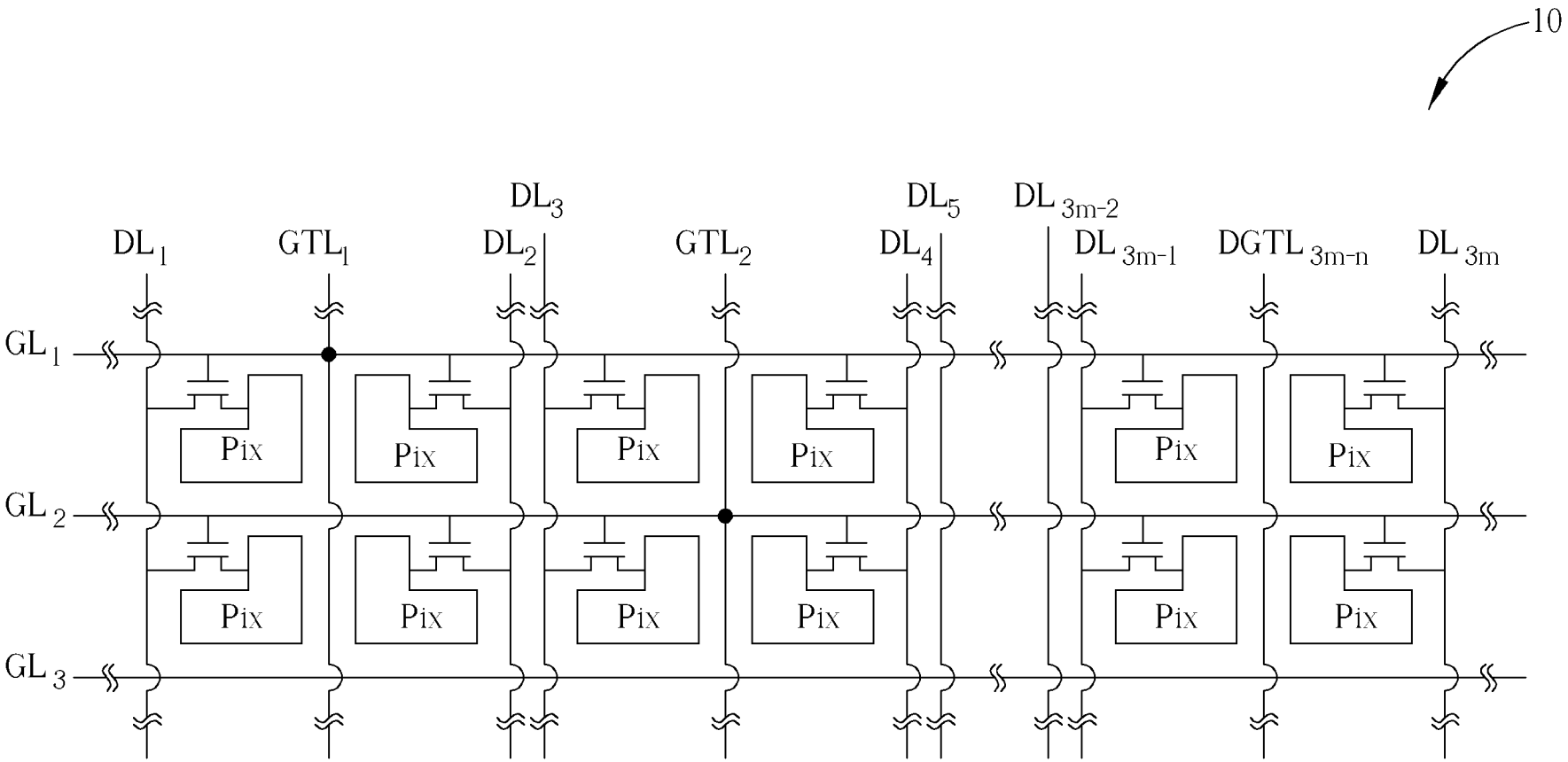
FIG. 2 is an enlarged schematic diagram of a part of the display device illustrated in FIG. 1.

With reference to FIG. 1 and FIG. 2, FIG. 1 is a schematic diagram illustrating the display device of a first preferred embodiment of the present invention, and FIG. 2 is an enlarged schematic diagram of a part of the display device illustrated in FIG. 1. As illustrated in FIG. 1 and FIG. 2, the display device 10 of the this embodiment includes a substrate 12, a plurality of gate lines GL1, GL2, . . . ,GLn, a plurality of data lines DL1, DL2, . . . , DLn, . . . , DL3m−1, DL3m, a plurality of gate tracking lines GTL1, GTL2, . . . , GTLn, and a plurality of dummy gate tracking lines DGTL1, DGTL2, . . . , DGTL3m−n. The gate lines GL1, GL2, . . . ,GLn are disposed in the active region 12A of the substrate 12, and the gate lines are substantially parallel to each other. The data lines DL1, DL2, . . . , DLn, . . . , DL3m−1, DL3m are disposed in the active region 12A of the substrate 12, and the data lines and the gate lines GL1, GL2, . . . ,GLn are substantially perpendicular to each other. A plurality of pixels Pix disposed in the active region 12A of the substrate 12 are defined by the data lines DL1, DL2, . . . , DLn, . . . , DL3m−1, DL3m and the gate lines GL1, GL2, . . . , GLn. Besides, each of the data lines DL1, DL2, . . . , DLn, . . . , DL3m−1, DL3m has a data signal input terminal 14 disposed in the first peripheral region 121P of the substrate 12. The gate tracking lines GTL1, GTL2, . . . , GTLn are disposed on the substrate 12. The gate tracking lines GTL1, GTL2, . . . , GTLn are substantially perpendicular to the gate lines GL1, GL2, . . . , GLn. It is therefore that the gate tracking lines GTL1, GTL2, . . . , GTLn are substantially parallel to the data lines DL1, DL2, . . . , DLn, . . . , DL3m−1, DL3m. The gate tracking lines GTL1, GTL2, . . . , GTLn are respectively disposed between parts of the two adjacent data lines. Besides, one terminal of each of the gate tracking lines GTL1, GTL2, . . . , GTLn is electrically connected to each of the corresponding gate lines GL1, GL2, . . . , GLn respectively, and the other terminal of each of the gate tracking lines GTL1, GTL2, . . . , GTLn is a gate signal input terminal 16 disposed in the first peripheral region 121P of the substrate 12 so that the gate tracking lines GTL1, GTL2, . . . , GTLn are configured and enable the gate lines GL1, GL2, . . . , GLn to be electrically connected to the driver (not marked) in the first peripheral region 121P respectively for subsequent external electrical connection. The dummy gate tracking lines DGTL1, DGTL2, . . . , DGTL3m−n are disposed on the substrate 12, and the dummy gate tracking lines DGTL1, DGTL2, . . . , DGTL3m−n are electrically disconnected to the gate lines GL1, GL2, . . . , GLn. The dummy gate tracking lines DGTL1, DGTL2, . . . , DGTL3m−n are disposed between parts of the two adjacent data lines respectively and substantially parallel to the data lines DL1, DL2, . . . , DLn, . . . , DL3m−1, DL3m. As illustrated in FIG. 2, in this embodiment, parts of the two adjacent data lines only have the gate tracking lines disposed therebetween, another parts of the two adjacent data lines only have dummy gate tracking lines disposed therebetween, and the other parts of the two adjacent data lines have no electrical connection lines disposed therebetween. Besides, not all of the distances between the two adjacent data lines are exactly equal. It is therefore that parts of the two adjacent data lines have a larger distance therebetween, and parts of the two adjacent data lines have a smaller distance therebetween. For example, the distance between the data line DL1 and the data line DL2 is larger than the distance between the data line DL2 and the data line DL3, and each of pixels Pix is disposed between the two adjacent data lines having larger distance therebetween. In addition, the gate tracking lines or the dummy gate tracking lines are disposed between the two adjacent data lines having larger distance therebetween but not disposed between the two adjacent data lines having smaller distance therebetween.

In this embodiment, the resolution of the display device 10 is n*m. It is therefore that the number of the gate lines is n, the number of the data lines is 3m, and n is smaller than 3m/2. Since the number of the gate tracking lines is equal to the number of the gate lines, the number of the gate tracking lines is also smaller than 3m/2 and equals n. In such a case, only parts of the two adjacent data lines having larger distance therebetween have the gate tracking lines disposed therebetween, other parts of the two adjacent data lines having larger distance therebetween have no gate tracking lines disposed therebetween, and the two adjacent data lines having smaller distance therebetween have no electrical connection lines disposed therebetween. For example, if the resolution of display device is 320*240, both the number of the gate lines and the number of the gate tracking lines are equal to 320. Meanwhile, the number of data lines is 240*3=720. In such a case, about 40 data lines having larger distances therebetween have no gate tracking lines disposed therebetween. As mentioned above, since the gate tracking lines and the data lines are disposed substantially parallel to each other and in an alternate way, the signals of the gate tracking lines and the signals of the data lines may influence each other, and lead to the loading effect. However, when the occurrence of the non-equalized loading effect is in the display device, the display quality will be seriously influenced. In view of such a problem, in the display device 10 of this embodiment, parts of the two adjacent data lines having larger distance therebetween have the dummy gate tracking lines DGTL1, DGTL2, . . . , DGTL3m−n disposed therebetween, and the dummy gate tracking lines DGTL1, DGTL2, . . . , DGTL3m−n are electrically disconnected to the gate lines GL1, GL2, . . . , GLn. In addition, the dummy gate tracking lines DGTL1, DGTL2, . . . , DGTL3m−n respectively have an modulating signal input terminal 18 disposed in the first peripheral region 121P.

When the display device 10 displays images, the gate driving signals can be applied to the gate lines GL1, GL2, . . . , GLn in sequence by way of each of the gate signal input terminals 16 of the gate tracking lines GTL1, GTL2, . . . , GTLn, and the image data signals can be applied to the data lines DL1, DL2, . . . , DLn, . . . , DL3m−1, DL3m in sequence by way of each of the data signal input terminals 14. In order to protect the display quality from the aforementioned non-equalized loading effect, the method of equalizing the loading effect of the display device of the present invention utilizes the modulating signals applied to each of the modulating signal input terminals 18 of the dummy gate tracking lines DGTL1, DGTL2, . . . , DGTL3m−n. The modulating signals do not be delivered to the gate lines GL1, GL2, . . . , GLn but generate the loading effect similar to the loading effect generated by the gate tracking lines GTL1, GTL2, . . . , GTLn so that the display device 10 can have the equalized loading effect and does not influence the display quality.

Figure 3:
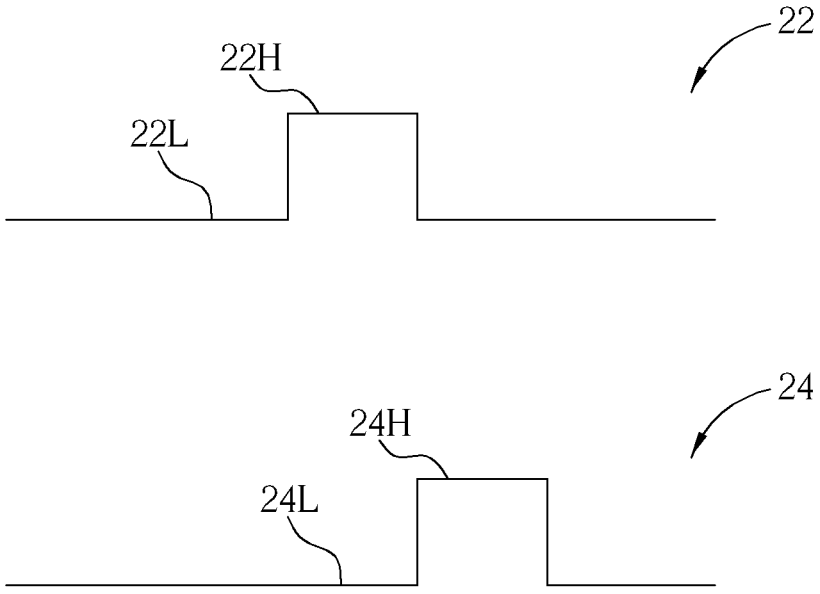
FIG. 3 and FIG. 4 are schematic diagrams of the modulating signals of two preferred embodiments of the present invention.
Figure 4:
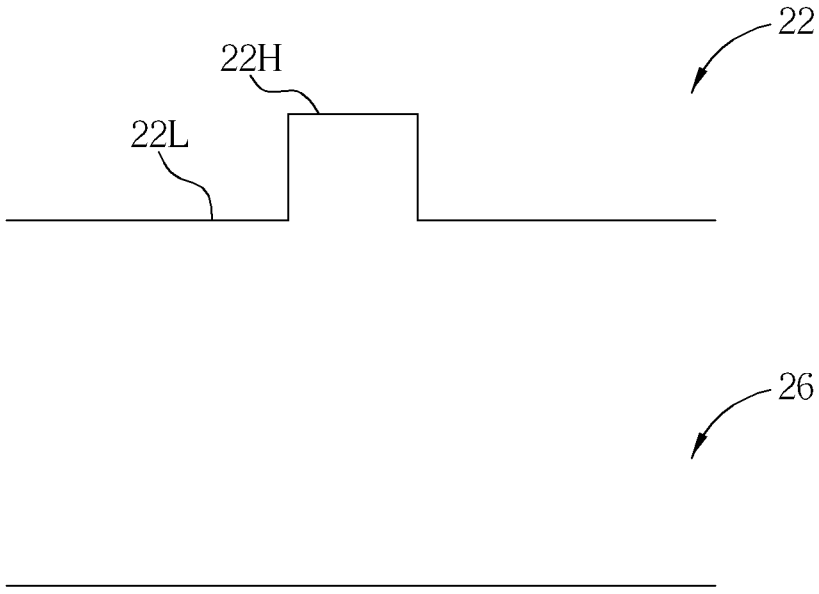

In the method of equalizing loading effect of the present invention, the modulating signals applied to the dummy gate tracking lines can be determined depending on the loading effect but not limited to specific signals. With reference to FIG. 3 and FIG. 4, FIG. 3 and FIG. 4 are schematic diagrams of the modulating signals of two preferred embodiments of the present invention. As illustrated in FIG. 3, a square wave signal 22, which is served as a gate driving signal and applied to the gate tracking lines, has a high level 22H and a low level 22L. The modulating signal applied to the dummy gate tracking line can also be a square wave signal 24 and have a high level 24H and a low level 24L. The high level 24H and low level 24L of the square wave signal 24 applied to the dummy gate tracking line DGTL may be respectively identical to the high level 22H and low level 22L of the square wave signal 22 applied to the gate tracking line but not limited thereto. The high level 24H and low level 24L of the square wave signal 24 can be adjusted depending on the different loading effect so that the high level 24H and low level 24L of the square wave signal can be larger or smaller than the high level of the gate driving signal. For instance, when the high level 22H and the low level 22L of the square wave signal 22 applied to the gate tracking lines are 17V and −7V respectively, the high level 24H and the low level 24L of the square wave signal 24 applied to the dummy gate tracking line are 17V and −7V respectively but not limited thereto. For instance, the high level 24H of the square wave signal 24 can be 25V, and the low level 24L of the square wave signal 24 can maintain −7V. As illustrated in FIG. 4, the modulating signal applied to the dummy gate tracking line DGTL can be a signal 26 with a constant level, and the constant level can be equal to the high level 22H of the square wave signal 22 applied to the gate tracking line but not limited thereto.

Figure 5:
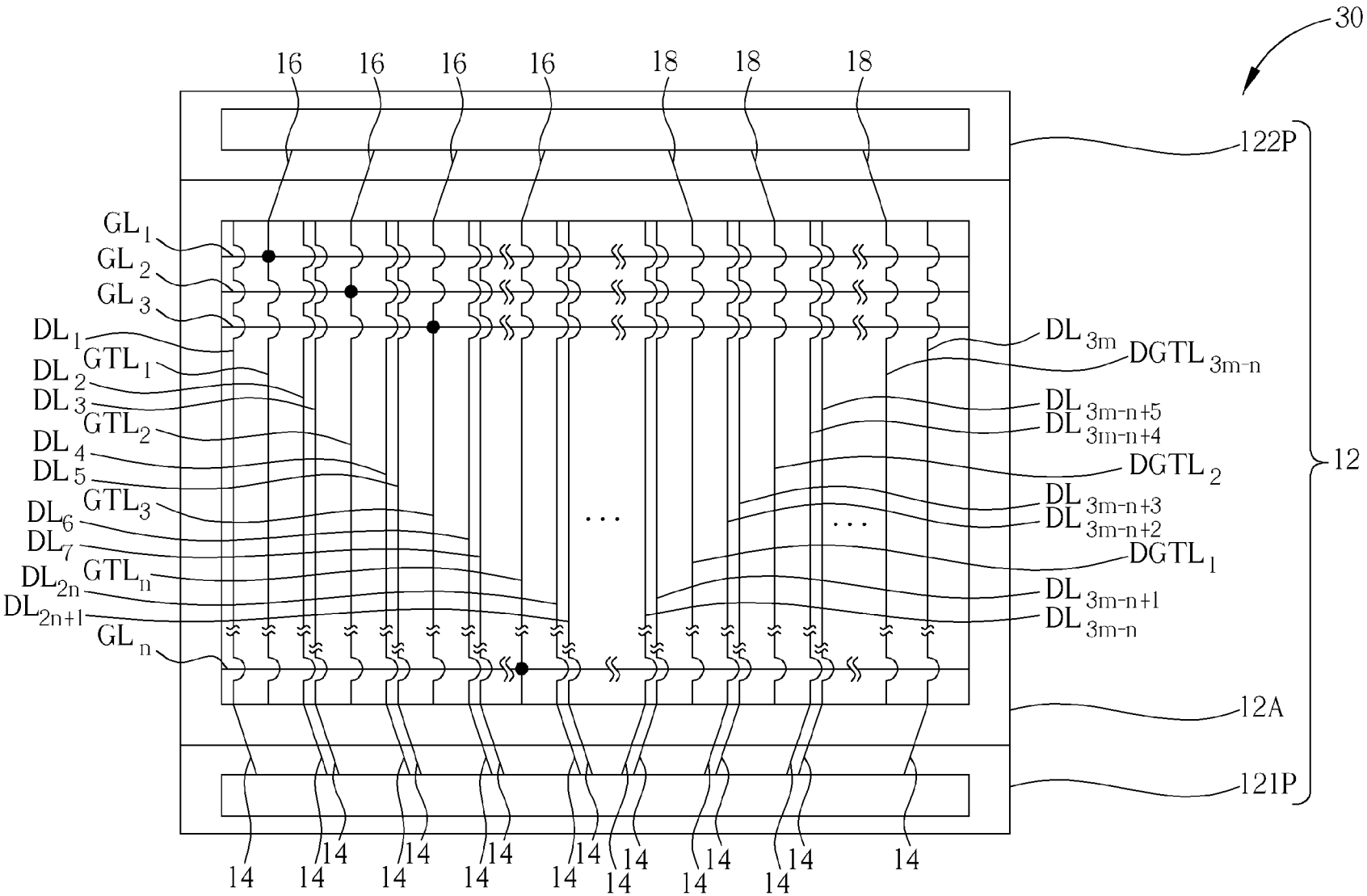
FIG. 5 is a schematic diagram of a variation of the display device of the first preferred embodiment of the present invention.

With reference to FIG. 5, FIG. 5 is a schematic diagram of a variation of the display device of the first preferred embodiment of the present invention. As illustrated in FIG. 5, the difference between the display devices respectively illustrated in FIG. 1 and FIG. 5 is that the substrate 12 of the display device 30 of this example further includes a second peripheral region 122P disposed on the different side of the substrate 12 with respect to the first peripheral region 121P such as the second peripheral region 122P disposed on another side of the substrate 12 opposite to the first peripheral region 121P, and the gate signal input terminals 16 of the gate lines GL1, GL2, . . . , GLn and the modulating signal input terminals 18 of the dummy gate tracking lines DGTL1, DGTL2, . . . , DGTL3m−n can be disposed in the second peripheral region 122P.

Figure 6:
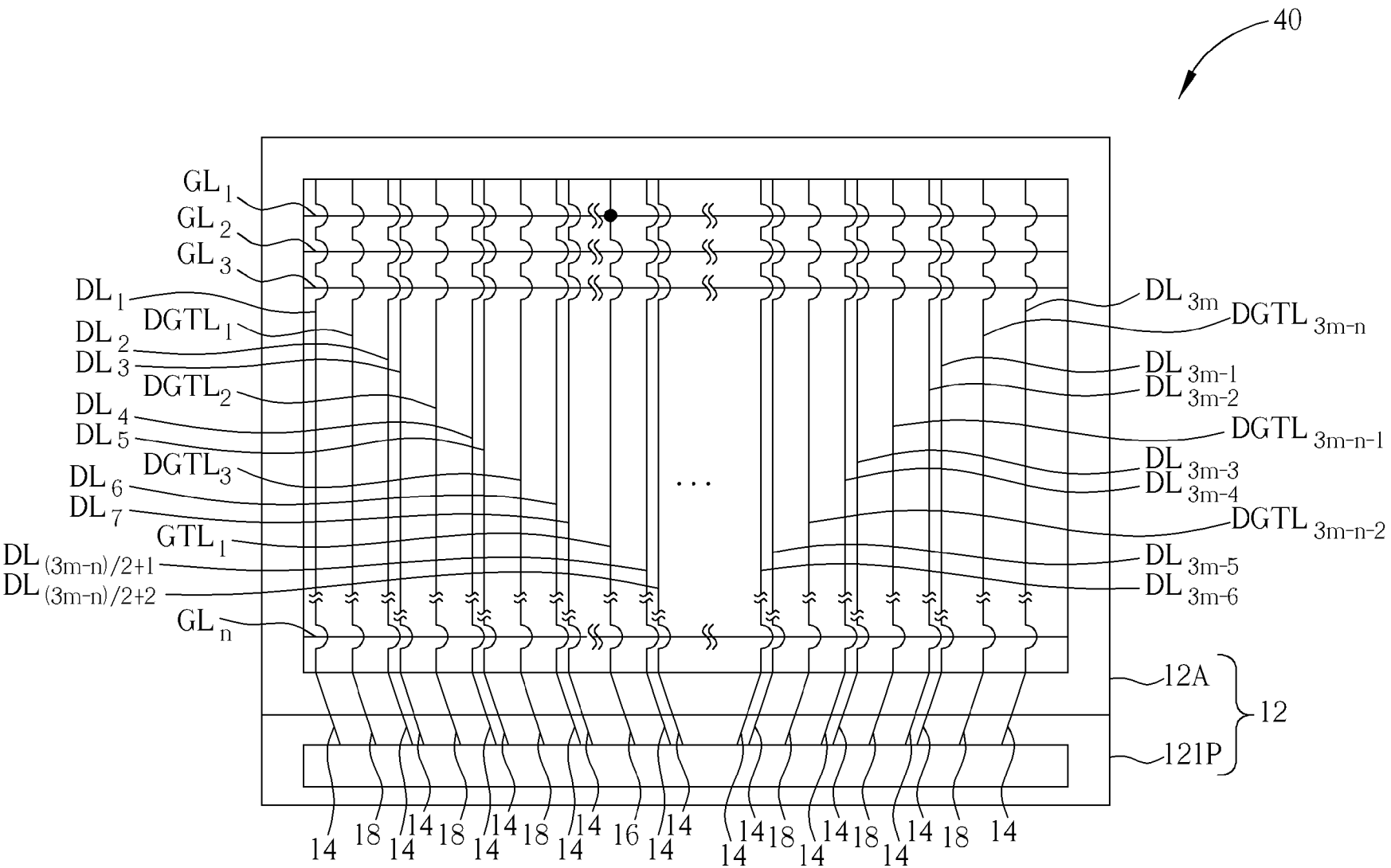
FIG. 6 is a schematic diagram of another variation of the display device of the first preferred embodiment of the present invention.

With reference to FIG. 6, FIG. 6 is a schematic diagram of another variation of the display device of the first preferred embodiment of the present invention. As illustrated in FIG. 6, the difference between the display devices respectively illustrated in FIG. 1 and FIG. 6 is that parts of the dummy gate tracking lines DGTL1, DGTL2, . . . , DGTL3m−n of the display device 40 of this example are disposed on a side of the active region 12A, and the other parts of the dummy gate tracking lines DGTL1, DGTL2, . . . , DGTL3m−n are disposed on the another side of the active region 12A.

Figure 7:
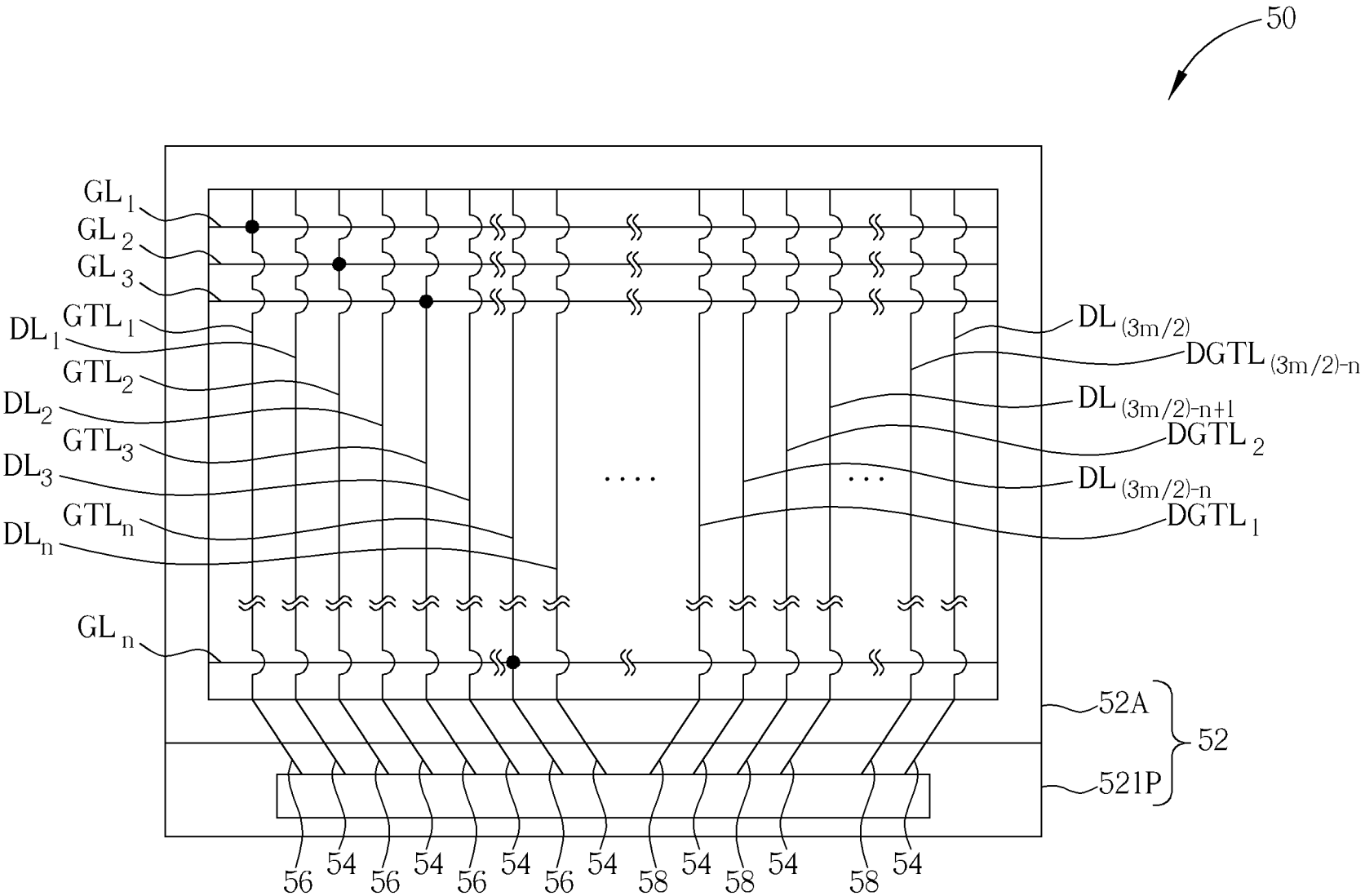
FIG. 7 is a schematic diagram of the display device of a second preferred embodiment of the present invention.
Figure 8:
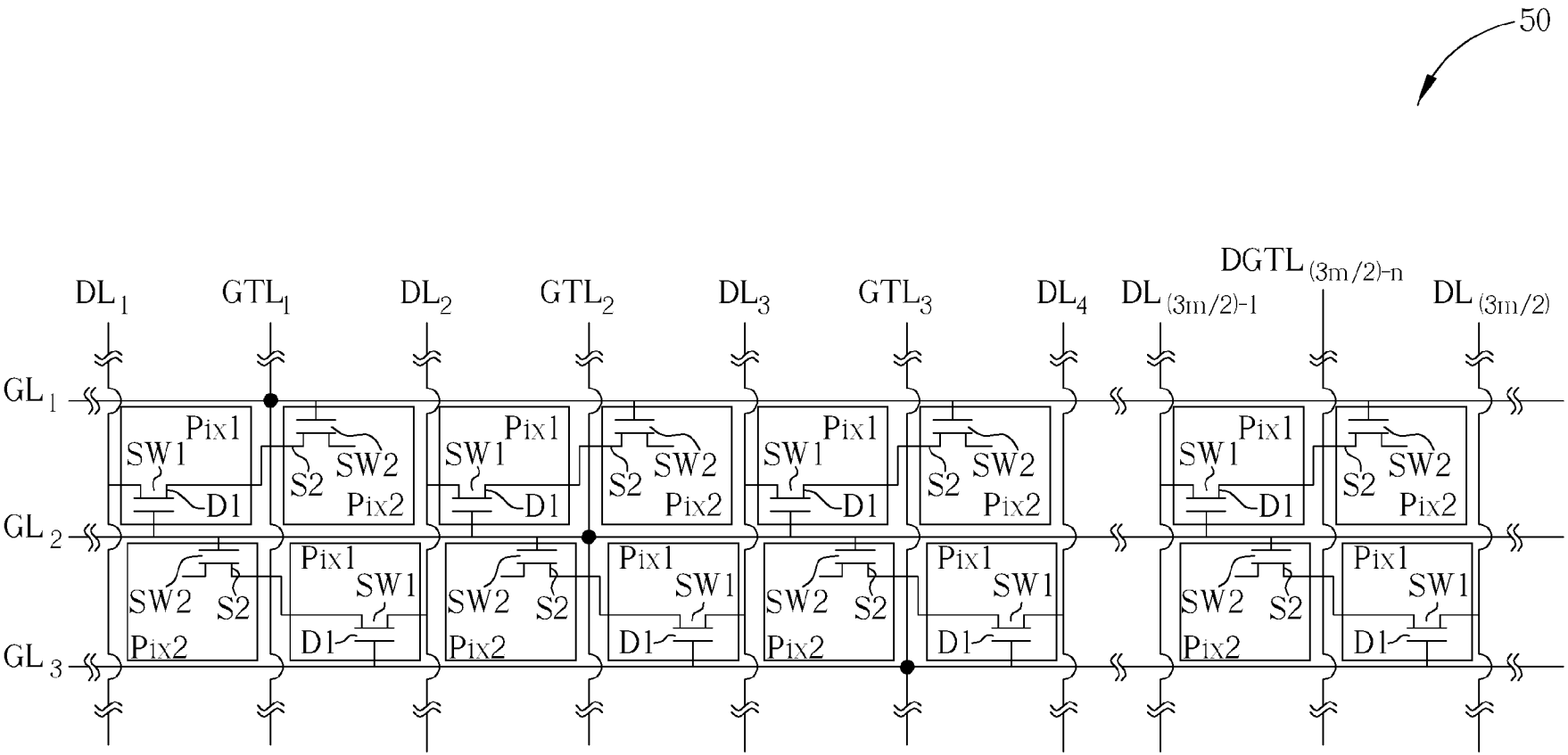
FIG. 8 is an enlarged schematic diagram of a part of the display device illustrated in FIG. 7.

With reference to FIG. 7 and FIG. 8, FIG. 7 is a schematic diagram of the display device of a second preferred embodiment of the present invention, and FIG. 8 is an enlarged schematic diagram of a part of the display device illustrated in FIG. 7. As illustrated in FIG. 7 and FIG. 8, the display device 50 of this embodiment includes a substrate 52, a plurality of gate lines GL1, GL2, . . . , GLn, a plurality of data lines DL1, DL2, . . . , DLn, . . . , DL(3m/2)−1, DL(3m/2), a plurality of gate tracking lines GTL1, GTL2, . . . , GTLn and a plurality of dummy gate tracking lines DGTL1, DGTL2, . . . , DGTL(3m/2)−n. The gate lines GL1, GL2, . . . , GLn are disposed in the active region 52A of the substrate 52 and substantially parallel to each other. The data lines DL1, DL2, . . . , DLn, . . . , DL(3m/2)−1, DL(3m/2) are disposed in the active region 52A of the substrate 52 and substantially perpendicular to the gate lines GL1, GL2, . . . , GLn, and a plurality of first pixels Pix 1 and a plurality of second pixels Pix 2 disposed in the active region 52A of the substrate 52 are defined by the data lines DL1, DL2, . . . , DLn, . . . , DL(3m/2)−1, DL(3m/2) and the gate lines GL1, GL2, . . . , GLn. Besides, each of the data lines DL1, DL2, . . . , DLn, . . . , DL(3m/2)−1, DL(3m/2) has a data signal input terminal 54 disposed in the first peripheral region 521P of the substrate 52. The gate tracking lines GTL1, GTL2, . . . , GTLn are disposed on the substrate 52, and the gate tracking lines GTL1, GTL2, . . . , GTLn and the gate lines GL1, GL2, . . . , GLn are substantially perpendicular to each other. In another words, it is therefore that the gate tracking lines GTL1, GTL2, . . . , GTLn and the data lines DL1, DL2, . . . , DLn, . . . , DL(3m/2)−1, DL(3m/2) are substantially parallel to each other, and the gate tracking lines GTL1, GTL2, . . . , GTLn are respectively disposed between parts of the two adjacent data lines. In addition, each of the terminals on a side of the gate tracking lines GTL1, GTL2, . . . , GTLn is electrically connected to each of the corresponding gate lines GL1, GL2, . . . , GLn, and each of the terminals on another side of the gate tracking lines GTL1, GTL2, . . . , GTLn is a gate signal input terminal 56 disposed in the first peripheral region 521P of the substrate 52. In such a case, the gate tracking lines GTL1, GTL2, . . . , GTLn are configured and enable the gate lines GL1, GL2, . . . , GLn to being electrically connected to the first peripheral region 521P for subsequent external electrical connection.

In this embodiment, each of the first pixels Pix1 includes a first switching device Sw1, each of the second pixels Pix2 includes a second switching device Sw2, and the drain electrode D1 of each of the first switching devices Sw1 is electrically connected to the source electrode S2 of each of the adjacent second switching devices Sw2 so that both the first pixel Pix1 and the corresponding second pixel Pix2 can receive the same data line signal. The resolution of the display device of this embodiment is n*m. In the aforementioned pixel arrangement, the number of the gate lines is n, the number of the data lines is 3m/2, and n is smaller than 3m/2. Since both the number of the gate tracking lines and the number of the gate lines are equal to n, the number n of the gate tracking lines is smaller than the number 3m/2 of the data lines. In such a case, only parts of the two adjacent data lines have gate tracking lines disposed therebetween, and the other parts of the two adjacent data lines do not have gate tracking lines disposed therebetween. For instance, if the resolution of the display device is 320*240, both the number of the gate lines and the number of the gate tracking lines are equal to 320 and the number of data lines is equal to 240*3/2=360. In such a case, about 40 data lines do not have gate tracking lines disposed therebetween. The display device 50 of this embodiment further includes a plurality of dummy gate tracking lines DGTL1, DGTL2, . . . , DGTL(3m/2)−n disposed on the substrate 52, the dummy gate tracking lines DGTL1, DGTL2, . . . , DGTL(3m/2)−n are electrically disconnected to the gate lines GL1, GL2, . . . , GLn, and the dummy gate tracking lines DGTL1, DGTL2, . . . , DGTL(3m/2)−n are respectively disposed between parts of the two adjacent data lines and substantially parallel to the data lines DL1, DL2, . . . , DLn, . . . , DL3m−1, DL3m. In addition, the dummy gate tracking lines DGTL1, DGTL2, . . . , DGTL3m−n respectively have a modulating signal input terminal 58 disposed in the first peripheral region 521P.

The method of equalizing loading effect of the display device of the present invention is to apply modulating signals by way of the modulating signal input terminals 58 of the dummy gate tracking lines DGTL1, DGTL2, . . . , DGTL(3m/2)−n. However, the modulating signals are not delivered to the gate lines GL1, GL2, . . . , GLn but generate loading effect similar to the loading effect generated by the gate tracking lines GTL1, GTL2, . . . , GTLn. In such a case, the display device 50 can have the equalized loading effect without influencing the display quality. In addition, in this embodiment, the gate signal input terminal 56 of the gate tracking line, the modulating signal input terminal 58 of the dummy gate tracking line and the data signal input terminal 54 of the data line are disposed in the first peripheral region 521P of the substrate 52, and the dummy gate tracking lines DGTL1, DGTL2, . . . , DGTL(3m/2)−n are only disposed on one side of the active region 52A. However, the application of this embodiment is not limited thereto. The relative positions of the gate signal input terminal 56, the modulating signal input terminal 58 and the data signal input terminal 54 of the data line can be moderately adjusted depending on the layout. In addition, the positions of the dummy gate tracking lines DGTL1, DGTL2, . . . , DGTL(3m/2)−n can be moderately adjusted depending on the different arrangement of the gate tracking lines GTL1, GTL2, . . . , GTLn so as to achieve the effect of equalizing the loading effect.

In summary, the display device and the method of equalizing loading effect of the display device of the present invention are characterized by disposing the dummy gate tracking lines between the data lines, and the dummy gate tracking lines are electrically disconnected to the gate lines. The modulating signals are applied to the dummy gate tracking lines so as to generate the balance loading effect. However, the aforementioned loading effect is similar to the loading effect generated by the gate tracking lines. In such a case, the display panel can have equalized loading effect so as to efficiently improve the display quality of the display device.

Those skilled in the art will readily observe that numerous modifications and alterations of the device and method may be made while retaining the teachings of the invention.

What is claimed is:

1. A display device, comprising:

a substrate;

a plurality of pixels, wherein each of the pixels comprises a switch device having a gate electrode and a source electrode;

a plurality of gate lines disposed on the substrate, wherein each of the gate lines is connected with a corresponding gate electrode of the switch device;

a plurality of data lines disposed on the substrate;

a plurality of gate tracking lines disposed on the substrate, wherein each of the gate tracking lines has a gate signal input terminal and is electrically connected between a driver and a corresponding gate line, at least one of the gate tracking lines is disposed between two adjacent data lines, a plurality of gate driving signals are applied to the gate lines by way of each of the gate signal input terminals of the gate tracking lines, at least one of the gate tracking lines intersects at least one of the gate lines, and the gate tracking lines are disconnected from the source electrode of the switch device; and a plurality of dummy gate tracking lines disposed on the substrate, wherein each of the dummy gate tracking lines is electrically disconnected from the gate lines and the data lines, each of the dummy gate tracking lines is parallel to the data lines, each of the dummy gate tracking lines is configured to deliver a modulating signal which is not delivered to the gate lines, at least one of the dummy gate tracking lines intersects at least one of the gate lines, and at least one of the dummy gate tacking lines is disposed between other two adjacent data lines.

2. The display device of claim 1, wherein the modulating signal comprises a square wave signal.

3. The display device of claim 1, wherein the modulating signal comprises a signal with constant level.

4. The display device of claim 1, wherein the substrate has a first peripheral region disposed on a side of the substrate, and each of the data lines has a signal input terminal disposed in the first peripheral region of the substrate.

5. The display device of claim 4, wherein each of the dummy gate tracking lines has a signal input terminal disposed in the first peripheral region of the substrate.

6. The display device of claim 4, wherein the substrate further has a second peripheral region disposed on another side of the substrate opposite to the first peripheral region, and each of the dummy gate tracking lines has a signal input terminal disposed in the second peripheral region of the substrate.

7. The display device of claim 1, wherein the substrate has an active region, and the dummy gate tracking lines are disposed on a side of the active region.

8. The display device of claim 1, wherein the substrate has an active region, a part of the dummy gate tracking lines are disposed on a side of the active region, and the other part of the dummy gate tracking lines are disposed on another side of the active region.

9. The display device of claim 1, wherein the gate driving signal and the modulating signal are identical.

10. The display device of claim 1, wherein the gate tracking lines are configured to deliver the gate driving signals to the gate electrodes of the switch devices via the gate lines.

11. The display device of claim 1, wherein the gate tracking lines and the data lines are disposed substantially parallel to each other and in an alternate way.

12. The display device of claim 1, wherein each of the gate tracking lines is not disposed between any two of the dummy gate tracking lines.

13. A display device, comprising:

a substrate;

a plurality of first pixels and a plurality of second pixels, wherein each of the first pixels comprises a first switching device, each of the second pixels comprises a second switching device, and a drain electrode of each of the first switching devices is electrically connected to a source electrode of the adjacent second switching device;

a plurality of gate lines disposed on the substrate, wherein each of the gate lines is connected with a corresponding gate electrode of the first switch device or the second switch device;

a plurality of data lines disposed on the substrate;

a plurality of gate tracking lines disposed on the substrate, wherein each of the gate tracking lines has a gate signal input terminal and is electrically connected between a driver and a corresponding gate line, at least one of the gate tracking lines is disposed between two adjacent data lines, and the gate tracking lines are disconnected from the source electrodes of the first switch devices and the second switch devices; and a plurality of dummy gate tracking lines disposed on the substrate, wherein each of the dummy gate tracking lines is electrically disconnected from the gate lines and the data lines, each of the dummy gate tracking lines is parallel to the data lines, each of the dummy gate tracking lines is configured to deliver a modulating signal which is not delivered to the gate lines, at least one of the dummy gate tracking lines intersects at least one of the gate lines, and at least one of the dummy gate tacking lines is disposed between other two adjacent data lines.

14. The display device of claim 13, wherein a plurality of gate driving signals are applied to the gate lines by way of each of the gate signal input terminals of the gate tracking lines, and at least one of the gate tracking lines intersects at least one of the gate lines.

15. The display device of claim 13, wherein the gate tracking lines are configured to deliver a plurality of gate driving signals to the gate electrodes of the first switch devices and the second switch devices via the gate lines.

16. The display device of claim 13, wherein each of the gate tracking lines is not disposed between any two of the dummy gate tracking lines.

* * * * *